United States Patent [19]

Brent

[11] 4,241,637

[45] Dec. 30, 1980

[54] STRINGED MUSICAL INSTRUMENTS OF GUITAR TYPE

[76] Inventor: Rachael E. Brent, P.O. Box 884, San Bruno, Calif. 94066

[21] Appl. No.: 54,472

[22] Filed: Jul. 3, 1979

[51] Int. Cl.[3] ..... G10D 1/08; G10D 3/14; G10H 3/18

[52] U.S. Cl. ..... 84/1.16; 84/267; 84/304; 84/306

[58] Field of Search ..... 84/1.16, 267, 297 R, 84/304, 306

[56] References Cited

U.S. PATENT DOCUMENTS

| | | | |
|---|---|---|---|
| 2,523,963 | 9/1950 | Mitchell | 84/267 |
| 3,194,870 | 7/1965 | Tondreau et al. | 84/1.16 |
| 3,251,257 | 5/1966 | Bunker | 84/267 |
| 3,407,696 | 10/1968 | Smith et al. | 84/297 R |
| 3,539,699 | 11/1970 | Johnson | 84/1.16 |
| 3,696,700 | 10/1972 | Berardi | 84/1.16 X |
| 3,910,151 | 10/1975 | Copeland | 84/267 |
| 4,201,108 | 5/1980 | Bunker | 84/1.16 |

*Primary Examiner*—Stanley J. Witkowski
*Attorney, Agent, or Firm*—John L. McGannon

[57] ABSTRACT

A stringed instrument in the form of an electric guitar having a body and a neck. A plurality of strings secured to the outer end of the neck extend along the neck and past a bridge carried by the body. The opposite ends of the strings are coupled with pegs which are rotatably mounted on the body adjacent to the bridge. The pegs are manually rotated by shafts which are located within the body itself. A worm gear connects each shaft to a respective peg. A knob is on the outer end of each shaft and each knob is located in a respective recess in a side-wall or an end wall of the body. A knob and a switch for control of amplified sounds are also recessed within the body. The body and neck are reduced in mass to decrease the weight of the instrument.

7 Claims, 9 Drawing Figures

STRINGED MUSICAL INSTRUMENTS OF GUITAR TYPE

The present invention relates to improvements in the construction and design of stringed musical instruments of the guitar type. More particularly it relates to guitar type instruments commonly referred to as solid body or semi solid body instruments, although many features may be adapted to other similar instruments.

Conventional instruments of this type consist of an elongated, reinforced neck, a large, heavy body area housing electrical amplification components, and a head area harboring tuning gears. The strings of the instrument are anchored in various ways to the body of the instrument, pass over a bridge also located upon the body, extend above the face of the neck of the instrument, over a nut at the top of the neck, and are finally fastened to tuning gears or pegs on the head of the instrument.

The weight and mass of traditional instruments often make the instruments difficult and exhausting to handle during use, especially during long periods of use when the instrument is supported by a strap across the musician's shoulder and back.

Other difficulties experienced with conventional instruments result from the placement of the tuning apparatus on the head portion of the instrument. This location leaves tuning gears or pegs exposed allowing the instrument to be accidentally knocked or bumped out of tune. The tuning devices are also placed inconveniently in relation to the hand closest to the body area, which is the hand the player utilizes when adjusting the tuning gears.

The principal object of this invention is to provide a musical instrument of the class described above, novel in design and construction, reduced in mass and weight allowing for easier and more comfortable manipulation. The body of the instrument is decreased in size, containing a minimum of excess body area.

Tuning gears may be sheltered within the reduced body area of the instrument. This will deter any unintentional adjustments of the strings' pitch. The use of this positioning place the tuning devices near the hand used to adjust these devices.

With the tuning gears housed within the body of the instrument, the strings are anchored beyond the nut, at the opposite end of the neck.

The use of this string anchoring system and placement of the tuning apparatus within the body will allow the elimination of the necessity of the head area.

The head of the instrument may be eliminated entirely, further reducing the mass and weight of the instrument, or it may be redesigned to serve an aesthetic or a variety of other functions.

Knobs and switches used for adjusting amplified sounds may also be recessed within the body of the instrument, remaining readily accessible to the player, while avoiding accidental adjustments.

These and other objects will become apparent to those skilled in the art from the following detailed description, taken with the accompanying drawings wherein.

Figure 1:
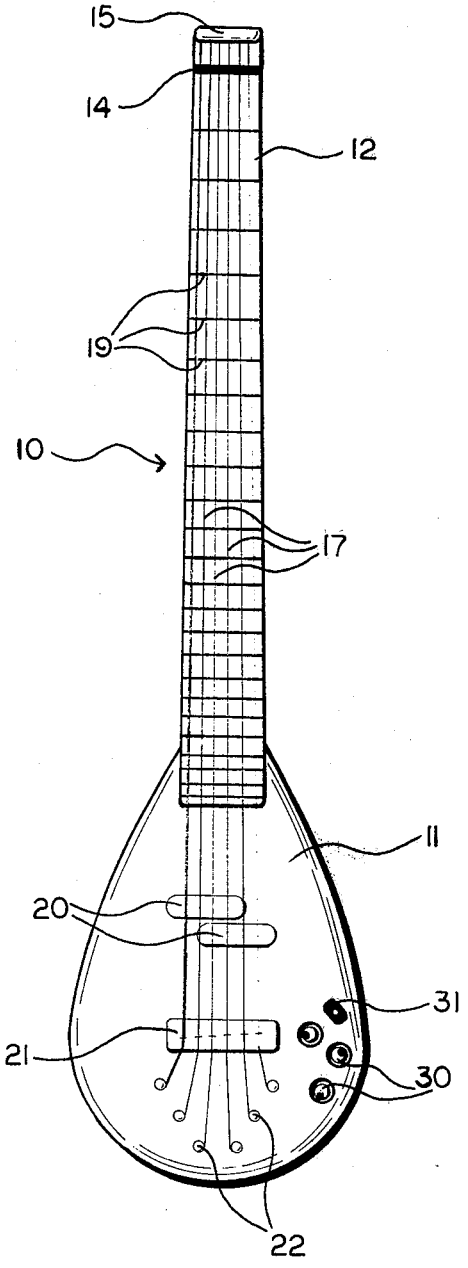
FIG. 1 is a front view of a stringed musical instrument having a body and a neck embodying the novel features of the invention.
Figure 2:
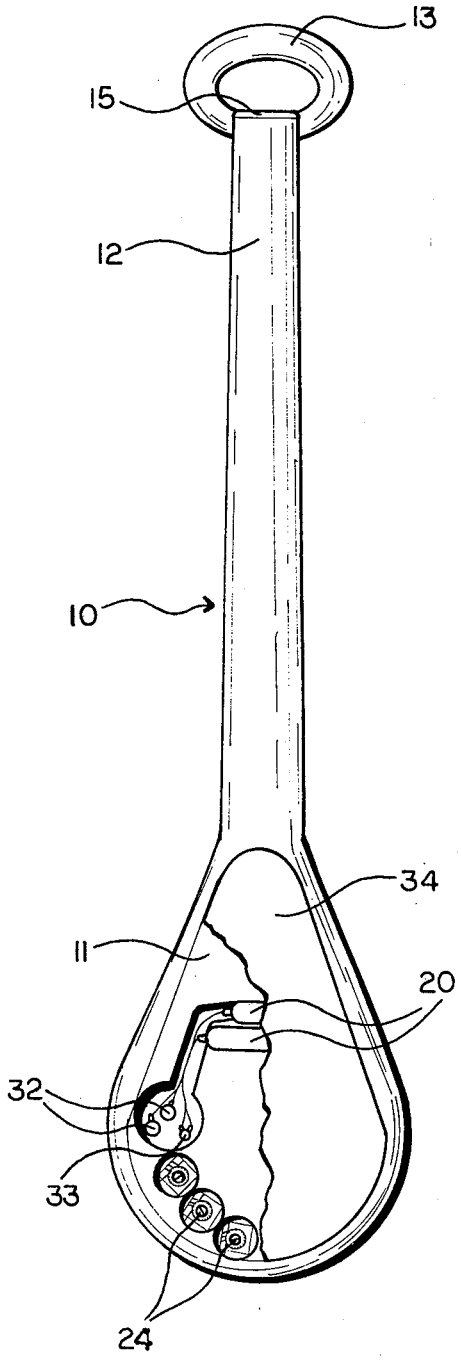
FIG. 2 is a back view of the same.
Figure 4:
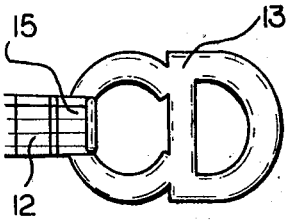
FIG. 4 is a partial front view featuring head area used as a monogram.
Figure 5:
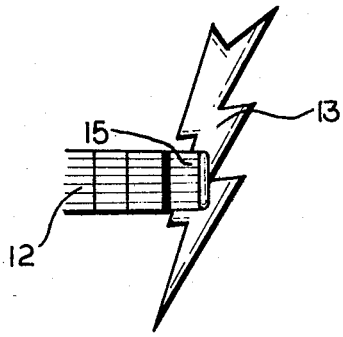
FIG. 5 is a partial front view featuring head area used for decoration.
Figure 6:
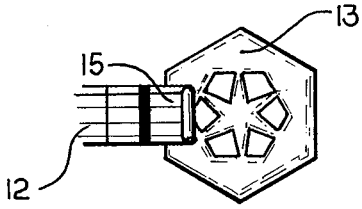
FIG. 6 is a partial front view featuring head area fashioned as an insignia or trade mark.

The features of the invention described in the following specification are applicable to various types of stringed instrument, and do not pertain solely to the guitar type instrument referred to below.

Reference numeral 10 designates, in its entirety, a guitar type instrument embodying a relatively small body area 11, from which a neck 12 extends and in some cases, a head area 13.

On the top end of the neck 12, above the nut 14, a string anchoring device 15 is fastened by the use of two or more screws or bolts 16, with the anchoring device 15 extending slightly above the height of the nut 14. The nut 14 and the anchoring device 15 may be separate units, or may be constructed as a single unit. A plurality of strings 17 are inserted into sockets provided for each of them in the anchoring device 15. The strings 17 are held secure by their end rings 18. The strings 17 then pass over the nut 16, travel parallel to the length of the neck 12 elevated above each fret 19, extend above pickups 20 housed within the body 11, pass over a bridge 21, and are fastened to individual tuning posts 22 which extend slightly above the heighth of the bridge.

Each of the strings 17 is tuned by tuning a respective knob 23 which activates the tuning gear 24 which is fastened to the tuning post 22.

Figure 9:
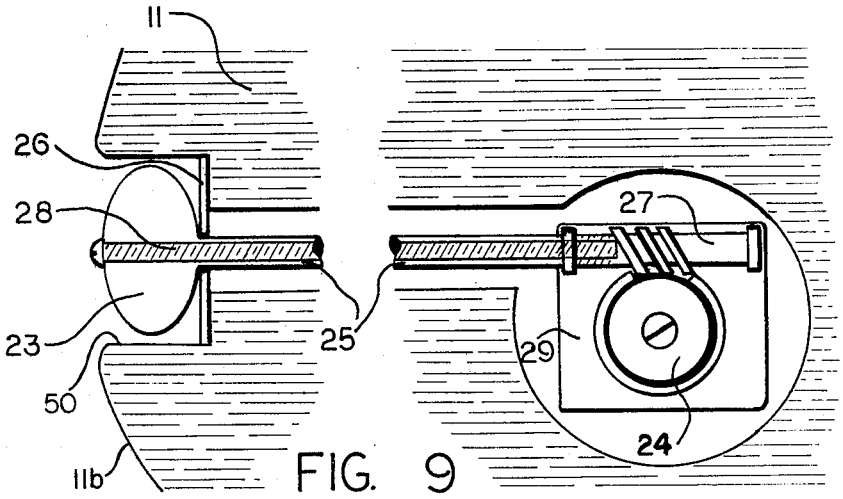
FIG. 9 is an enlarged fragmentary sectional view featuring tuning apparatus recessed within the body area.

The tuning knob 23 is placed into a recess 50 in the side wall 11*a* or an end wall 11*b* of body 11, by inserting an elongated post 25 attached to the knob 23 through washer or plate 26 which has been placed into the recessed as shown in FIG. 9. The post 25 then continues until it is fastened to the worm gear 27 where they are fastened together by the use of an elongated bolt 28.

The worm gear 27 and the spur gear 24 are held in an engaged position by a plate 29, which is anchored to the body 11 of the instrument 10.

Figure 8:
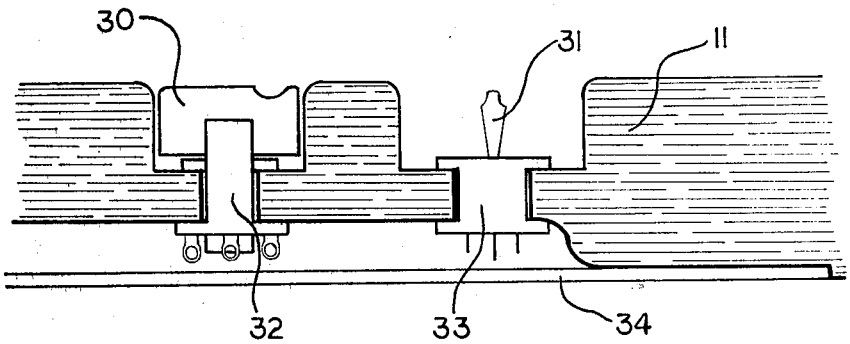
FIG. 8 is an enlarged fragmentary sectional view featuring recessed knob and switch in the body.

The control knobs 30 and control switches 31 are recessed in the body 11 as shown in FIG. 8. Both the knob 30 and switch 31 are shaped so that they may be adjusted at the touch of a finger tip.

The control knob components 32 and control switch components 33 are connected to pickups 20. These components 32 and 33, and tuning gears 24, as well as other devices such as conventional truss rod adjusting nut and pick ups 20 are concealed behind a back cover plate 34 which may be removed for any alterations or repairs that may be desired.

Figure 3:
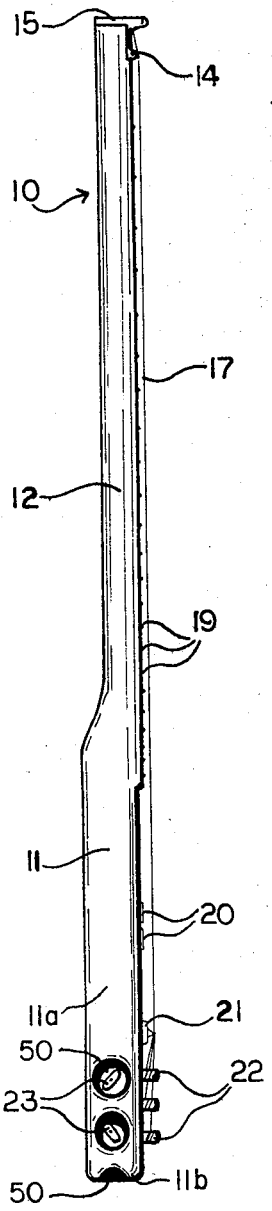
FIG. 3 is a side view of the same.
Figure 7:
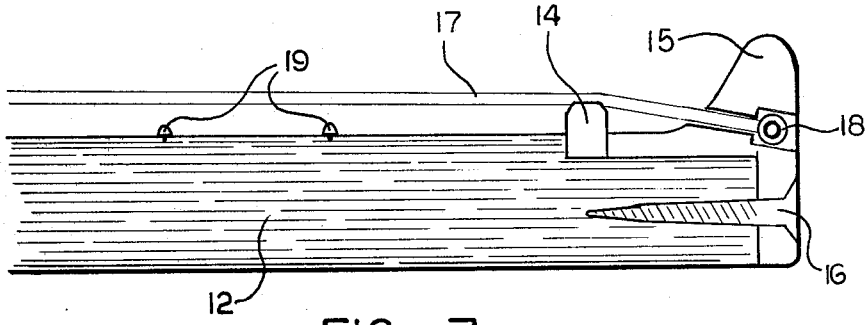
FIG. 7 is an enlarged fragmentary sectional view featuring string attachment at the top of the neck.

The head area 13 may be eliminated as shown in FIGS. 1, 3, and 7, or may be maintained for a variety of functions as shown in FIGS. 2, 4, 5 and 6.

While the preferred form of the invention has been shown and described in some detail, it will be understood by those skilled in the art that the invention is not limited to such details, but may take various other forms within the scope of the claims.

What I claim is:

1. In a guitar: a body having a pair of opposed extremities and a bridge thereon between said extremities; an elongated neck extending outwardly from one extremity of the body, the outer end of the neck having means for anchoring first ends of a plurality of strings in fixed positions thereon, the strings adapted to extend from said outer end of the neck along the neck past said one extremity and the bridge to respective locations adjacent to the opposite extremity of the body; means carried by the body adjacent to said opposite extremity thereof and coupled with the opposite ends of the strings for applying tension to the strings as the strings engage the bridge, the tension applying means including a shaft for each string, respectively, each shaft having a knob on the outer end thereof, the body having a recess for each knob, respectively, the recesses extending into the body and having outer, open ends, the knobs being within respective recesses and being accessible through the open ends of the recesses to permit rotation of the shafts.

2. In a guitar as set forth in claim 1, wherein the body has a pair of sidewalls and an end wall, at least one of the sidewalls and the end wall having said recesses.

3. In a guitar as set forth in claim 1, wherein said body has an outer surface, said bridge being secured to said outer surface, the tensioning means including a rotatable peg for each string, respectively, the opposite ends of the strings being coupled to respective pegs, each peg projecting outwardly from said outer surface of the body, and means coupling each shaft with a respective peg.

4. In a guitar as set forth in claim 3, wherein said coupling means includes a worm and a worm gear for each peg, respectively.

5. In a guitar as set forth in claim 3, wherein the pegs project outwardly from said outer surface of the body by a distance greater than the distance by which the bridge projects outwardly from said outer surface.

6. In a guitar as set forth in claim 1, wherein the outer end of the neck has a string anchoring device provided with a projecting portion, said neck having a nut projecting outwardly from the neck by a distance less than the distance by which the projecting portion projects outwardly from the neck.

7. In a guitar as set forth in claim 3, wherein is provided a control knob and a control switch for connection to electrical pick-ups on the body, said body having a pair of recesses in the outer surface thereof for the control knob and the control switch, respectively.

* * * * *